United States Patent [19]

Wolfseder

[11] Patent Number: 4,558,734

[45] Date of Patent: Dec. 17, 1985

[54] HEAT EXCHANGER HAVING A SET OF PIPES

[75] Inventor: Alfons Wolfseder, Freising, Fed. Rep. of Germany

[73] Assignee: Anton Steinecker Maschinenfabrik GmbH, Freising, Fed. Rep. of Germany

[21] Appl. No.: 472,852

[22] Filed: Mar. 7, 1983

[30] Foreign Application Priority Data

Apr. 16, 1982 [DE] Fed. Rep. of Germany ..... 8210809

[51] Int. Cl.[4] ..... F28B 1/00

[52] U.S. Cl. ..... 165/113; 165/143

[58] Field of Search ..... 165/110, 111, 143, 145, 165/113

[56] References Cited

U.S. PATENT DOCUMENTS

| | | | |
|---|---|---|---|
| 844,803 | 2/1907 | Hiller | 165/143 |
| 1,278,279 | 9/1918 | Wright et al. | 165/113 X |
| 1,489,420 | 4/1924 | Bell | 165/113 |
| 1,783,286 | 12/1930 | Hartman | 165/145 |
| 1,978,897 | 10/1934 | Feldmeier | 165/143 |
| 2,392,638 | 1/1946 | Bowman et al. | 165/111 |
| 3,439,738 | 4/1969 | Dixon et al. | 165/143 |
| 3,865,180 | 2/1975 | McKenny et al. | 165/111 X |
| 4,137,938 | 2/1979 | Logan | 165/81 X |
| 4,210,199 | 7/1980 | Doucette et al. | 165/143 X |
| 4,410,035 | 10/1983 | White | 165/111 |

FOREIGN PATENT DOCUMENTS

| | | | |
|---|---|---|---|
| 336321 | 3/1916 | Fed. Rep. of Germany | 165/113 |
| 26199 | of 1899 | United Kingdom | 165/143 |
| 15884 | of 1906 | United Kingdom | 165/143 |

*Primary Examiner*—Albert W. Davis, Jr.
*Assistant Examiner*—Peggy A. Neils
*Attorney, Agent, or Firm*—Learman & McCulloch

[57] ABSTRACT

A heat exchanger having a plurality of parts each of which comprises a set of pipes and a housing which conducts steam. The housing of each part is provided on its steam discharge end with a condensate extraction connection that is angularly offset on the periphery of the housing relative to the steam discharge connection. Such a heat exchanger is distinguished by a simple, space-saving construction and easy maintenance and cleaning while permitting good heat transfer.

5 Claims, 4 Drawing Figures

HEAT EXCHANGER HAVING A SET OF PIPES

BACKGROUND OF THE INVENTION

The invention relates to a heat exchanger having a set of pipes, with the heat exchanger pipes being arranged horizontally for heating a flowing medium with steam.

Heat exchangers having a set of pipes are known in which the heating medium contained in the pipes is guided partially in crossflow and partially in unidirectional and counterflow to the medium to be heated. In such heat exchangers relatively large differences in temperature between the heating medium and the medium to be heated occur at individual points on the heat exchanger. In certain applications (for instance, in the use of such heat exchangers for boiling wort in beer production) this can lead to disadvantages in that as a result of the excessive temperature difference incrustations and deposits are produced in the heat exchanger which considerably impair the heat transfer and require costly maintenance work.

The state of the art also includes double pipe heat exchangers in which the heating medium and the medium to be heated are led in counterflow to each other. In order to achieve a sufficient surface area of the heat exchanger it is known in this case for a plurality of parts of the heat exchanger connected to each other by deflectors to be connected in series. However, when steam is used as the heating medium such heat exchangers have the considerable disadvantage that the condensate produced when the steam is cooled must in practice be forced through the whole heat exchanger to the steam outlet end which results in considerable impairment of the heat transfer.

SUMMARY OF THE INVENTION

An object of the invention is to avoid the disadvantages of the known constructions by the provision of a heat exchanger having a set of pipes of the type referred to and which produce a particularly good degree of heat transfer with a low temperature difference between the steam used as a heating medium and the medium to be heated, while at the same time a simple space-saving construction and easy access to the interior of the heat exchanger for maintenance and cleaning purposes is ensured.

This object is achieved according to the invention by the following features:

(a) The heat exchanger contains a plurality of parts which are connected in series via connecting pieces through which the medium to be heated and steam pass in counterflow, and which each consist of a set of pipes for the medium to be heated and a housing which surrounds the set of pipes and conducts the steam;

(b) the housing of each part is provided at its steam outlet end with a condensate extraction connection which is offset on the periphery of the housing relative to the steam outlet connection.

A satisfactory counterflow motion between the medium to be heated and the steam over the whole length of the heat exchanger is achieved by feature (a). The smallest possible temperature difference thus produced between the steam and the medium to be heated in many cases (especially in the boiling of wort) avoids disruptive deposits and precipitation in the medium to be heated.

Extraction of the condensate at the end of each part of the heat exchanger is achieved by feature (b). This prevents larger quantities of condensate being forced through the whole heat exchanger housing by the steam and restricting the heat transfer by the unavoidable contact with the set of pipes for the medium to be heated. The heat exchanger according to the invention is thus distinguished by an excellent heat transfer.

The connecting pieces provided at the two front ends of the heat exchanger for connecting the heat exchanger parts facilitate easy access to the interior of the heat exchanger for cleaning and maintenance purposes.

DESCRIPTION OF THE DRAWINGS

Further features of the heat exchanger according to the invention are set forth in the following description and illustrated in the accompanying drawings, in which.

DETAILED DESCRIPTION

Figure 2:
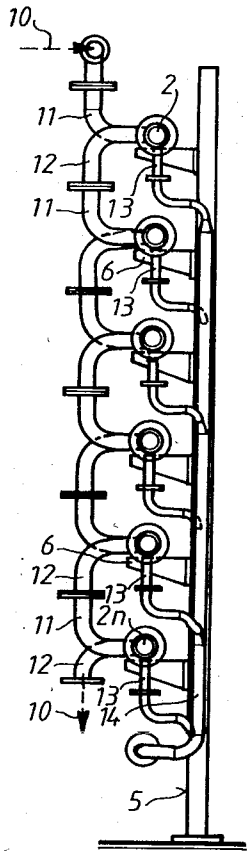
FIG. 2 is a partially cutaway front view of the heat exchanger shown in FIG. 1 (approximately along the line II—II in FIG. 1)

In the illustrated embodiment the heat exchanger 1 contains a number of heat exchanger parts 2, 2*a*, 2*b* . . . 2*n* which are spaced one above the other and through which the medium to be heated and the steam pass in counterflow. The heat exchanger parts are all constructed on straight lines, and the parts lying adjacent to each other have the same vertical spacing HA (from center to center) in the central region of the length of the heat exchanger. The parts 2, 2*a* . . . 2*n* are connected in series by connecting pieces which will be described in greater detail below. Each of these parts 2, 2*a* . . . 2*n* consists essentially of a set of pipes (indicated by 3 in the part 2*a*) for the medium to be heated and a housing 4 which surrounds the set of pipes 3 and conducts the steam. The parts 2, 2*a* . . . 2*n* can be held in one or several frames 5 by lateral brackets 6.

The heat exchanger 1 has a delivery pipe 7 at the front end on its lowest part 2*n* and a discharge pipe 8 also at the front end, on its uppermost part 2 for the medium to be heated which is indicated by arrows 9. The steam (broken arrows 10) intended for heating the medium 9 is on the other hand delivered to the heat exchanger 1 at its uppermost part 2 and extracted at the lowest part 2*n*.

The housing 4 of each part 2, 2*a* . . . 2*n* has a steam delivery connection 11 in the region of one axial end thereof and a steam discharge connection 12 in the region of the opposite axial end, and in the case of any two parts (e.g., 2 and 2*a*, 2*a* and 2*b* etc.) lying immediately above one another the steam delivery connections and the steam discharge connections 11 or 12 respectively are located at the opposite ends in each case. This arrangement is chosen so that in each case the upper part (e.g., 2) is connected to the part (e.g., 2*a*) lying immediately below it, or the housing 4 thereof, by the steam discharge connection 12 of the upper part and the steam delivery connection 11 of the lower part so that steam is conducted. The steam delivery connections 11 and the steam discharge connections 12 are preferably formed by elbow-like pipe sections (with approximately 90° angle) which are connected laterally onto the housing 4 of the relevant part 2, 2a . . . 2n (cf. in particular FIG. 2) The steam delivery connections 11 and the steam discharge connections 12 are preferably constructed in the same way and can be releasably connected to each other by flange connections, as shown.

The housing 4 of each part 2, 2a, 2b . . . 2n is provided on its steam outlet end with a condensate extraction connection 13 which is angularly offset on the periphery of the housing relative to the steam discharge connection 12. In the embodiment illustrated in the drawing it is especially preferred to provide this condensate extraction connection 13 in the lower part of the periphery of the housing and to provide the steam discharge connection 12 at approximately 90° relative thereto on the periphery of the housing (cf. in particular FIG. 2). To enable the condensate forming in the housing 4 to run off reliably, the housing 4 of each part 2, 2a . . . 2n is arranged with a sufficient slight slope towards the appertaining condensate extraction connection 13.

In the region of each front end of the heat exchanger 1 a condensate extraction pipe 14 is provided to which all the condensate extraction connections 13 of the appertaining front end of the heat exchanger are connected. The two condensate extraction pipes 14 can be constructed as stand pipes and can be equipped with closable valves 15.

Figure 1:
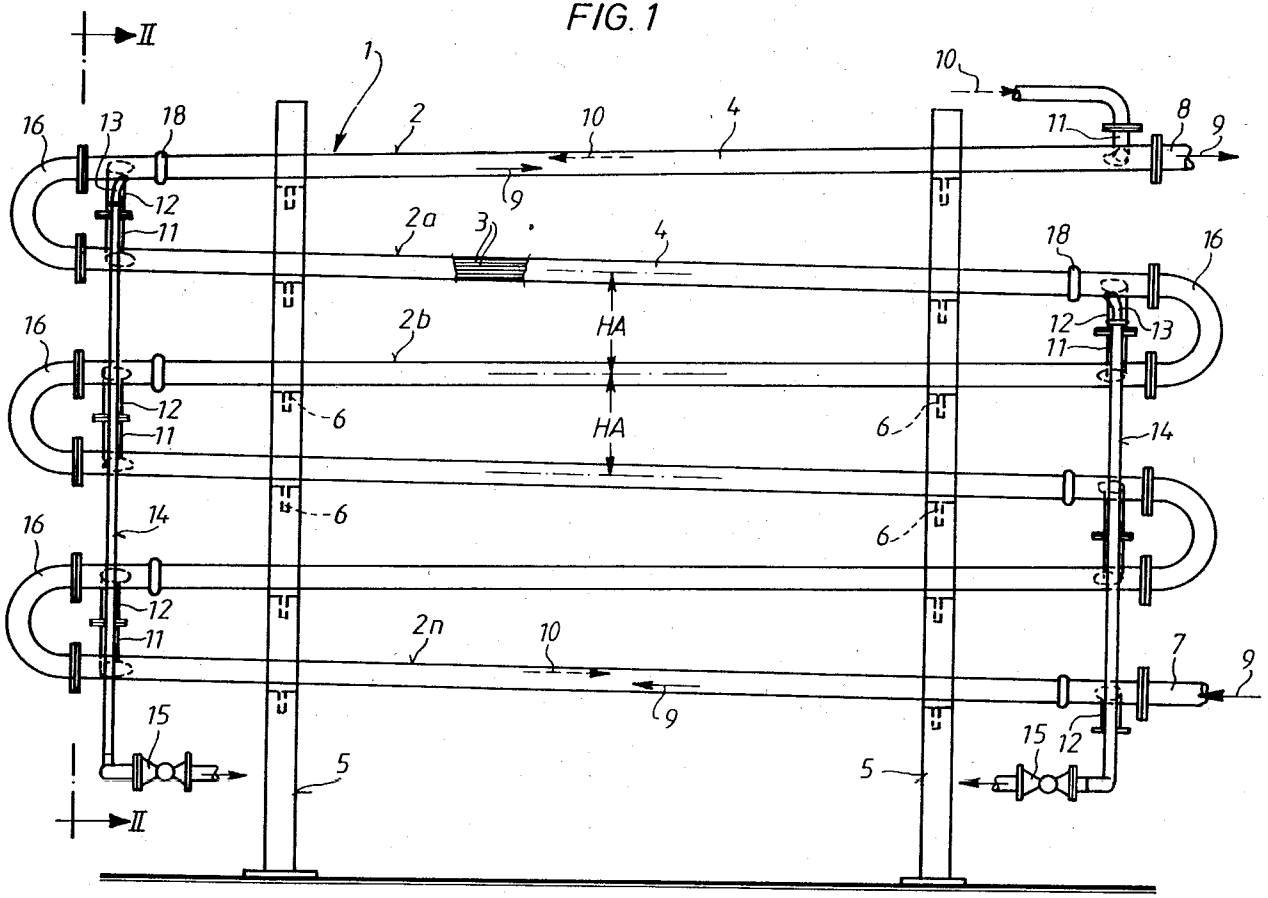
FIG. 1 is a largely schematic side elevational view of the heat exchanger having a set of pipes.

Of the parts 2, 2a, 2b . . . 2n arranged one above another in series any two adjacent parts lying one above the other (e.g. 2 and 2a, 2a and 2b etc.) are connected to each other by a connecting piece 16 which is provided at a front end of the heat exchanger 1 and intended for the medium to be heated and is constructed in the form of a simple pipe bend extending over a radius slightly less than 180° taking into account the slope in the housing of the individual parts 2, 2a. . . 2n. These pipe bends or connecting pieces 16 are provided alternately at one and the other end of the heat exchanger over the height of the heat exchanger 1 (cf. FIG. 1) so as to produce a continuously connected pipeline from the parts 2, 2a . . . 2n lying one above the other and these connecting pieces 16.

Figure 3:
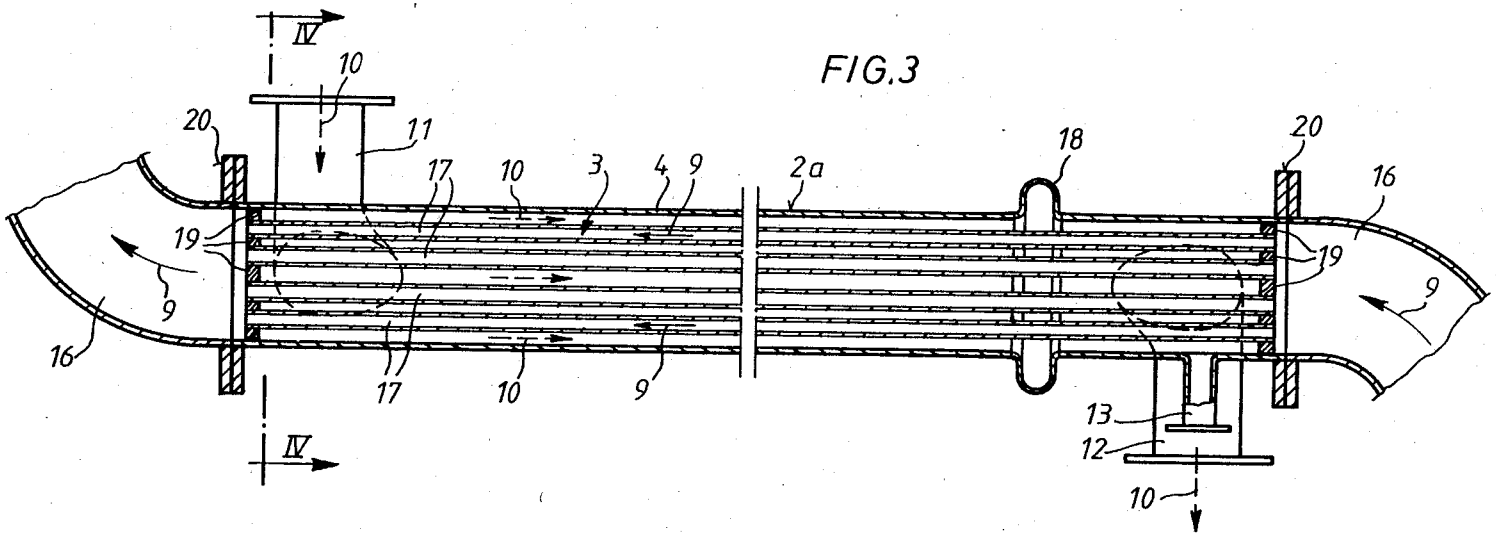
FIG. 3 is a greatly enlarged, sectional view of a part of the heat exchanger according to FIG. 1.
Figure 4:
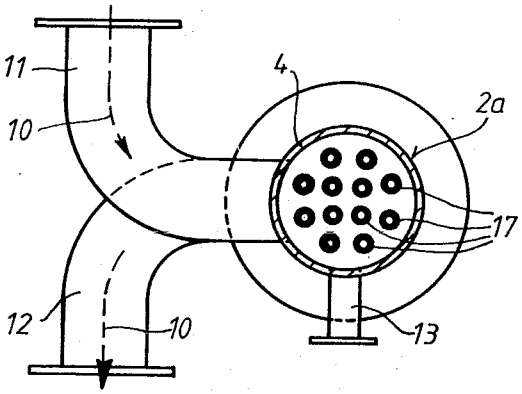
FIG. 4 is a cross-section along the line IV—IV in FIG. 3.

The internal construction of a part of the heat exchanger, e.g., the part 2a, is shown in greater detail in particular in FIGS. 3 and 4. The horizontally arranged heat exchanger pipes 17 of the set of pipes 3 provided inside the housing 4 are evenly distributed over the internal cross-section of the housing 4 (cf. FIG. 4) so that each individual heat exchanger pipe 17 can be completely circumcirculated by the steam conducted in the housing 4. During operation steam (broken arrows 10) is introduced through such heat exchanger part via the steam delivery connection 11 into the housing 4 of the part (e.g., 2a) and again extracted at the outlet end of the housing 4 through the steam discharge connection 12 and passed into the part (e.g., 2b) lying below. This heating steam (arrows 10) flows in counterflow to the medium (arrows 9) to be heated which enters the pipes 17 through the connecting piece 16 coming up from below, passes through the pipes and is conducted further upwards through the upwardly leading connecting piece 16 (at the steam delivery end). Good circumcirculation of all the horizontally arranged heat exchanger pipes 17 in the housing can also be assisted by the installation of baffle plates which are known per se inside the housing which ensure that the heating steam flowing through the housing 4 in the longitudinal direction is deflected many times.

It can also be advantageous to equip each part 2, 2a . . . 2n with compensating arrangements which are known per se and which are produced by providing the housing 4 over its length with at least one length compensator 18 (for the purpose of compensating for temperature-contingent variations in length) while the heat exchanger pipes 17 are arranged on at least one end, e.g., the steam delivery end of the part 2a, so as to be slidably movable in pipe mountings 19 with sufficient sealing in the longitudinal direction.

The connecting pieces 16 are also advantageously connected by means of releasable flange connections 20 to the appertaining parts of their housings 4, so that the interior of these heat exchanger parts is easily accessible for example for cleaning and maintenance purposes.

I claim:

1. A heat exchanger construction comprising a plurality of vertically spaced apart tubes arranged adjacent and alongside one another, each of said tubes having substantially horizontal run; sealing means at opposite ends of each of said tubes and closing the associated run; a plurality of spaced apart pipes open at both ends thereof accommodated within each of said tubes and extending along the run thereof and through the sealing means at both ends of said run; an inlet adjacent one end of each of said tubes inward of the associated sealing means for introducing a heating medium into the associated run; an outlet in communication with and adjacent the opposite end of each of said tubes at a level angularly offset from its bottom and inward of the associated sealing means for extracting said heating medium from the associated run; a drain in communication with the bottom of each of said tubes adjacent said opposite end and inward of the associated sealing means for draining the tube; U-shaped connector means connecting an end of each of said tubes to an end of an adjacent tube whereby the contents of said pipes may pass from tube to tube; means for introducing fluid to be heated to the pipes within an endmost one of said tubes; and means for discharging such fluid from the pipes within the opposite endmost tube, the inlet and outlet of each of said tubes being so located that the flow of heating medium through each of said tubes is countercurrent to the flow of fluid through the pipe of the associated tube.

2. A construction according to claim 1 wherein all of the drains at corresponding ends of said tubes are in communication with one another.

3. A construction according to claim 1 wherein each of said tubes is sloped in a direction toward its said outlet.

4. A construction according to claim 1 wherein said tubes are vertically spaced from one another by a substantially uniform distance.

5. A construction according to claim 1 wherein all of the drains at corresponding ends of said runs communicate with a single extraction pipe.

* * * * *